US006240730B1

(12) United States Patent
Thiele

(10) Patent No.: US 6,240,730 B1
(45) Date of Patent: Jun. 5, 2001

(54) STEAM TURBOGENERATOR SET HAVING A STEAM TURBINE AND A DRIVEN MACHINE FOR PRODUCING ELECTRICAL POWER, AND METHOD FOR OPERATION OF THE STEAM TURBOGENERATOR SET

(75) Inventor: Rudolf Thiele, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/583,988

(22) Filed: May 30, 2000

Related U.S. Application Data

(63) Continuation of application No. PCT/DE98/03490, filed on Nov. 26, 1998.

(30) Foreign Application Priority Data

Nov. 28, 1997 (DE) ..... 197 52 946

(51) Int. Cl.[7] ..... F01K 13/02
(52) U.S. Cl. ..... 60/646; 60/657
(58) Field of Search ..... 60/646, 657, 658

(56) References Cited

U.S. PATENT DOCUMENTS

| | | | | |
|---|---|---|---|---|
| 3,292,372 | * | 12/1966 | Michel | 60/657 X |
| 3,359,731 | * | 12/1967 | Anderson | 60/657 |
| 4,044,561 | | 8/1977 | Hohn . | |
| 4,049,972 | | 9/1977 | Crowdy et al. . | |
| 4,498,301 | * | 2/1985 | Tsubouchi | 60/657 |
| 5,490,386 | * | 2/1996 | Keller et al. | 60/657 X |

FOREIGN PATENT DOCUMENTS

| | | |
|---|---|---|
| 1 426 796 | 7/1969 | (DE) . |
| 2 105 494 | 8/1972 | (DE) . |
| 31 46 354 | 1/1987 | (DE) . |
| 38 15 679 | 1/1992 | (DE) . |
| 42 27 280 | 8/1993 | (DE) . |
| 44 44 587 | 6/1996 | (DE) . |
| 196 06 088 | 8/1997 | (DE) . |
| 196 36 674 | 3/1998 | (DE) . |
| 0 306 634 | 3/1989 | (EP) . |
| 1 134 391 | 11/1968 | (GB) . |

OTHER PUBLICATIONS

Published International Application No. WO 94/01713 (Haase), dated Jan. 20, 1994, as mentioned on p. 4 of the application.

* cited by examiner

*Primary Examiner*—Hoang Nguyen
(74) *Attorney, Agent, or Firm*—Herbert L. Lerner; Laurence A. Greenberg; Werner H. Stemer

(57) ABSTRACT

A steam turbogenerator set includes a common shaft for a steam turbine and a driven machine with a generator, downstream of which a frequency converter is connected. Electrical power can be fed at a predetermined frequency through the frequency converter into a load network. Bearings of the common shaft are cooled and lubricated with water. Since there is no gearing requiring cooling and lubricating, and control valves for the steam are also driven without oil, the risk of contamination or fire caused by oil is avoided. A method for operation of the steam turbogenerator set is also provided.

11 Claims, 2 Drawing Sheets

STEAM TURBOGENERATOR SET HAVING A STEAM TURBINE AND A DRIVEN MACHINE FOR PRODUCING ELECTRICAL POWER, AND METHOD FOR OPERATION OF THE STEAM TURBOGENERATOR SET

CROSS-REFERENCE TO RELATED APPLICATION

This application is a continuation of copending International Application No. PCT/DE98/03490, filed Nov. 26, 1998, which designated the United States.

BACKGROUND OF THE INVENTION

Field of the Invention

The invention relates to a steam turbogenerator set having a steam turbine unit and a driven machine unit connected thereto for producing electrical power. The invention also relates to a method for operation of the steam turbogenerator set.

Turbogenerator sets are generally used in order to feed an electrical network having a frequency which is 50 Hz (or 60 Hz). At high ratings (around 30 MVA or more), it is economical to operate the steam turbine at speeds of 3000 (or 3600) revolutions per minute when using two-pole generators. However, for lower ratings, higher speeds of more than 3000 to 16,000 revolutions per minute are more economical for the turbine, depending on the rating. In that case, a gearbox is required to reduce the speed between the steam turbine which rotates at high speed, and the generator which rotates to match the desired electrical power frequency.

In that case, particular problems occur with the lubrication and cooling of the bearings and gearbox.

In the gearbox, not only do bearings for gearbox shafts require special lubrication but, in particular, heavily loaded gearbox teeth of mutually engaging tooth edges must also be carefully lubricated and cooled. The high rotation speeds and loads in each case demand a specific coolant and lubricant, for which purpose, until now, only oils have been available, in practice.

Conventionally, a steam turbogenerator set has an oil circuit which essentially carries out three tasks:

Firstly, the oil is used as a lubricant and coolant for the bearings of the steam turbine and generator. Secondly, the control valves of the steam turbine are operated by actuating cylinders using oil for hydraulic purposes. Thirdly, the oil is used to cool and lubricate the gearbox. Heat losses which occur in each case are emitted to the oil circuit and are carried away to an oil/water heat exchanger. Overall, relatively large amounts of oil are required to carry out those three tasks. In such a case, the ratio of lubricating oil: control oil: gearbox oil is about 1:6:2.

Those amounts of oil can lead to a number of problems. In the event of leakages in the oil circuit, there is a risk of the oil which emerges contaminating the surrounding area. That necessitates precautionary measures such as oil trays and walls surrounding oil containers. Furthermore, emerging oil represents a serious fire hazard. If the oil comes into contact with parts of the turbine at temperatures up to 500° C., there is a high probability of ignition. Alternative liquids which can be used are difficult to ignite but are generally toxic. Complex and expensive measures are required for steam turbine shaft bearings, particularly for steam turbogenerator sets with an axial stream outlet flow, to ensure that no oil can enter the outlet stream from the turbine. That would result in the steam circuit being contaminated by an extraneous medium, which could lead to a wide range of defects.

The amount of oil in the oil circuit can admittedly be reduced considerably if actuating cylinders operated hydraulically by oil are dispensed with and a change is made to a different medium (which then requires its own circuit) or different drive principles for the control valves (for example linear drives which, in some circumstances, likewise require cooling). However, that does not avoid impurities occurring in the steam outlet as a result of bearing oil emerging from the turbine, or oil emerging into the surrounding area. A high level of technological complexity is required for that purpose, as is implicitly evident from numerous patent applications (for example European Patent Application 0 306 634 A2, International Publication No. WO 94/01713 and German Published, Non-Prosecuted Patent Application DE 196 06 088 A1). That problem can be solved by shafts with magnetic bearings (for example in German Patent DE 42 27 280 C1, corresponding to U.S. patent application Ser. No. 08/390,107, filed Feb. 17, 1995, or German Patent DE 31 46 354 C2) or by other magnetic bearings with elements using permanent magnets and/or superconductors (German Published, Non-Prosecuted Patent Application DE 44 44 587 A1, corresponding to U.S. patent application Ser. No. 08/876,655, filed Jun. 16, 1997), although those likewise involve complexity. However, no promising substitute which operates without any coolant is yet known for the gearbox.

SUMMARY OF THE INVENTION

It is accordingly an object of the invention to provide a steam turbogenerator set having a steam turbine unit and a driven machine unit connected thereto for producing electrical power, and a method for operation of the steam turbogenerator set, which overcome the hereinaforementioned disadvantages of the heretofore-known devices and methods of this general type and which avoid difficulties caused by lubricant and/or coolant.

The invention in this case is primarily based on avoiding the dangers and difficulties resulting from oil by using actuating cylinders, which use water for hydraulic purposes, for the valves which control or regulate the steam supply, or other control elements, that operate without oil, for those valves. The same applies to the oil-free bearings for the generators and for the equipment in a driven machine unit (generators, pumps, compressors, etc.). In particular, the invention provides for the use of linear motors as control drives for the valves. Water-cooled bearings are suitable in any case for the driven machine unit, provided the amounts of water required for lubrication and cooling are fed into the bearings at an adequate pressure.

The invention is also based on a gearbox being required only if the rotational speed of the shaft which is driven by the steam turbine is reduced or increased. However, if it is possible to operate the steam turbine and the driven machine at the same rotational speed, then there is no need for a gearbox and the problems associated with cooling of the gearbox do not occur. In order to ensure that electrical power at a predetermined frequency is fed into an electrical network or to a load, a frequency converter, which is connected to the generator, is used to match the generator rotational speed (that is to say the rotational speed of the high-speed steam turbine) to the lower frequency of the electrical power or of the network. If the driven machine unit contains pumps, compressors or other machines, then there is likewise no need for a gearbox, provided these corresponding machines are constructed for the high rotational speed of the steam turbine. Thus, in particular, the steam turbine of the steam turbine unit and the generator of the driven machine unit can be connected to one another through a coupling or through flanges.

Finally, the invention is based on the capability of using water as a lubricant and coolant in the steam turbine unit, and then of avoiding the risk of fire associated with the use of oil, and the risk of environmental damage caused by leakages. Thus, in practice, it is possible to dispense with the use of oil and the like throughout the entire turbogenerator set. Furthermore, no extraneous media then enter the outlet steam flow from the turbine if the bearing is located in an axial outlet flow, and the water for lubrication and cooling is taken from the water circuit of the steam power station.

With the foregoing and other objects in view there is provided, in accordance with the invention, a method for operating a steam turbogenerator set, which comprises providing a steam turbine unit having a steam turbine and a shaft bearing; providing a driven machine unit having a generator for producing electrical power; providing a shaft having a first shaft part borne in the shaft bearing of the steam turbine unit and a second shaft part with oil-free bearings in the driven machine unit; supplying the steam turbine unit with steam through valves driven without oil; rotating the first shaft part with the steam turbine; transmitting the same rotation of the shaft to the generator without an interposition of gearing or a gearbox by the second shaft part; feeding water to the shaft bearing as a coolant and lubricant; and feeding electrical power from the generator through an electrical frequency converter into a load network at a predetermined network frequency.

With the objects of the invention in view, there is also provided a steam turbogenerator set, comprising a steam turbine unit having a steam turbine and a shaft bearing; a further driven machine unit having a generator and oil-free bearings; a shaft having a first shaft part seated in the shaft bearing in the steam turbine and a second shaft part seated in the oil-free bearings in the generator; control valves with oil-free drives, the control valves conducting steam to the steam turbine causing the first shaft part to rotate and in turn causing the second shaft part to drive the generator, directly without an interposition of gearing or a gearbox; a circuit supplying water to the shaft bearing as a lubricant and coolant; and a frequency converter connected downstream of the generator for producing electrical power at a desired frequency to be fed into a load network.

According to the invention, a steam turbogenerator set is provided having a steam turbine unit and a driven machine unit which includes a generator, with the units being connected to one another without a gearbox. A shaft part which is driven by a steam turbine and a shaft part which drives the generator are thus directly coupled to one another, for example through the use of a flange, as shaft elements, in the region between the units, in order to form a common shaft, or to form a rigid (for example integral) shaft. In that case the two bearings between the steam turbine and the driven machine can then be replaced by a single bearing.

An oil-free circuit, namely a water circuit, is used for lubrication and cooling of the shaft bearings in the turbine unit. Likewise, only oil-free bearings are used for the bearings for this shaft in the driven machine unit. In this case, the generator is provided in order to produce electrical power at a desired frequency, and a frequency converter is connected downstream of the generator, for this purpose. The control valves for the steam turbine can be operated, in particular, by a linear drive or a similar drive unit which in any case operates without oil (in particular combined with electrical or electronic control).

The steam turbine unit may have a different structure and, for example, may include one or more steam turbines which have a steam outlet directed upward or downward (generally in the direction to the side) or in the axial direction. An axial outlet flow is generally required where steam turbines with generators are installed on one level (for example also in an assembly with a gas turbine). In this case, the generator is then coupled on the steam inlet flow side.

Oil or any other lubricant can thus be replaced by water throughout the entire steam turbogenerator set. The turbogenerator set preferably contains only components which operate without oil, since stationary parts (for example the frequency converter) can also be cooled by other media (for example air or water).

A water circuit (or a number of water circuits) from which water supply channels lead to the individual bearings, is provided, in particular for cooling and lubricating the shaft bearings. It is also possible to provide a number of shaft parts and/or shaft bearings in the steam turbine unit and to supply them through the use of a common water circuit. The water used as the coolant and lubricant is advantageously fed back from the shaft bearings to the water circuit through water outlet channels. This water circuit preferably allows the cooling systems of a generator unit or any other driven machine unit as well as the steam supply to the steam turbine unit to be operated simultaneously. This also applies to a frequency converter, if one is provided and requires cooling. If they require cooling, linear drives to operate the control valves for the steam turbine may also be supplied by the water circuit. It is thus possible for a single water circuit to dissipate all of the heat losses from a turbogenerator set. The thermal energy introduced into the circulating water is preferably extracted through the use of a heat exchanger. This heat exchanger is operated through the use of an open water circuit, but may also be an air-cooled heat exchanger.

Since water has a relatively high heat-absorption capacity, the individual cooling components may be relatively small. Furthermore, components having a small size may be used since it is possible to save the previously normal volumes for the control oil which is used to control the actuating cylinders for control valves for the steam turbine and the gearbox oil. This thus also results in a reduction in the total amount of circulating medium. This affects not only the size of components such as pipelines and coolers, but also the power required for the pump system which drives the water circuit. Water losses in the water circuit are preferably replaced by processed water, which is available in any case in power stations in order to supply the water for feeding steam into the steam turbine in a corresponding circuit.

Since the lubricant and coolant circuit is operated with the same medium as the steam turbine, the circulating water which is required may also be taken from the steam/water circuit of the power station. The circulating water is advantageously processed at the same time. Any wear particles or other impurities which occur and are caused, for example, by the shaft bearings, are filtered out.

The same medium is used not only as the coolant and lubricant for the shaft bearings but also to produce steam for the steam turbine. Therefore, a shaft bearing may be disposed in the outlet steam flow from the steam turbine, particularly in steam turbines with an axial outlet flow, without any need to be concerned about the risk of an extraneous medium contaminating the steam circuit if there are any leakages in the bearing seal.

Other features which are considered as characteristic for the invention are set forth in the appended claims.

Although the invention is illustrated and described herein as embodied in a steam turbogenerator set having a steam turbine unit and a driven machine unit connected thereto for producing electrical power, and a method for operation of the steam turbogenerator set, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
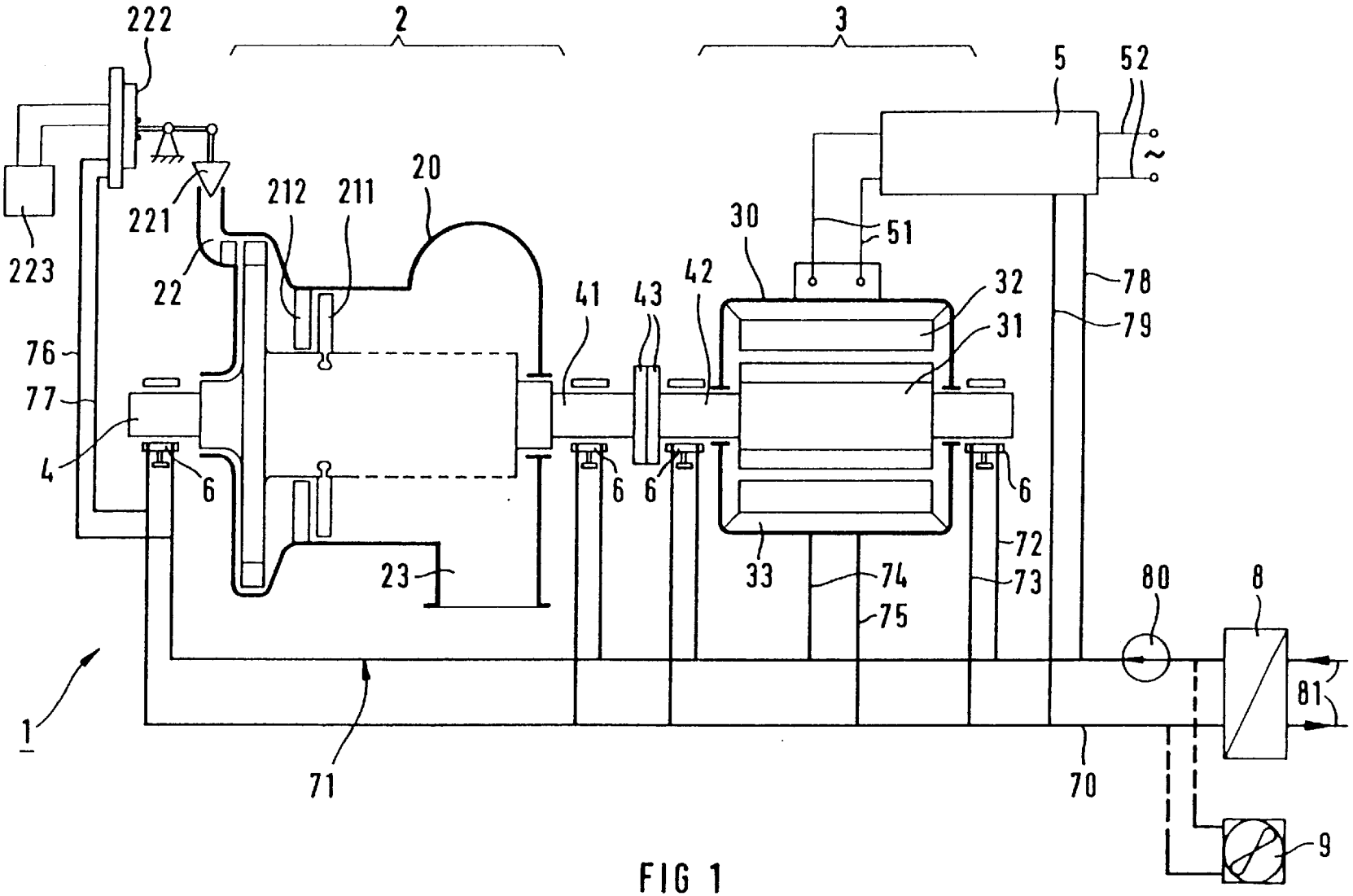
FIG. 1 is a diagrammatic and schematic view of an oil-free steam turbogenerator set using water as a lubricant and coolant, with a steam outlet flow at a side (specifically, directed downward)

Referring now to the figures of the drawings in detail and first, particularly, to FIG. 1 thereof, there is seen a steam turbogenerator set which has been given reference numeral 1 overall and which contains a steam turbine unit 2 and a generator unit 3 as another driven machine unit. The units 2 and 3 are connected to one another by a shaft 4. This shaft includes a number of shaft parts (two shaft elements 41, 42), which rotate at the same rotation speed. The first shaft element 41 passes through the steam turbine unit 2. Rotor blades 211 of the turbine are fitted to this shaft element 41 within a steam turbine 20, although the drawing shows only two of these blades, for clarity. Stator blades 212 are fitted between the rotor blades 211 on a turbine wall of the steam turbine 20 although, once again, only two of them are shown, for clarity. The second shaft element 42 passes through a generator 30. An armature 31 of the generator 30 is fitted to the shaft element 42. A stator 32 of the generator 30 surrounds the armature 31 in the circumferential direction, and is located in a casing of the generator 30. The two shaft elements 41 and 42 of the shaft 4 are connected to one another through the use of flanges 43.

Electrical power which is thus produced is passed from the generator 30 through cables 51 to a frequency converter 5. This frequency converter 5 converts a generator electrical power output frequency, which is governed by the rotational speed and the number of poles on the shaft 4, to a frequency which corresponds to the required network frequency of the electrical power network to be fed. The electrical power in this case is emitted to the electrical power network through the use of cables 52.

Steam which drives the turbine 20 is supplied by a steam supply 22. The steam supply is controlled by control valves 221 which, for their part, are operated through one or more linear drives 222 and electrical regulators 223.

A turbine steam outlet flow in this exemplary embodiment is in the form of a steam outlet flow device 23 directed downward. Such a downward steam outlet flow at the side has an advantage over an axial outlet flow (see FIG. 2 for comparison) which is that there is no need for a bearing for the shaft 4 within the steam outlet flow device 23.

The shaft 4 is borne by shaft bearings 6. In this case, these bearings are in the form of journals. Water is used as a lubricant and coolant for these shaft bearings 6, and is provided through the use of a water inlet 71 and a water return 70. The water in the circuit is kept in motion by a pump 80. The circulating water which acts as the coolant and lubricant is supplied to the shaft bearings 6 through water supply channels 72 which originate from the water inlet 71. The circulating water acts as the coolant and lubricant in the shaft bearing 6. Heat energy produced by sliding friction in the bearings is thus carried away by the circulating water. The circulating water is supplied from the shaft bearings 6 to the water return 70 through water outlet channels 73.

The water circulating in the water circuit 70, 71 may advantageously be used to cool other components in the turbogenerator set. In the exemplary embodiment of FIG. 1, the circulating water is likewise used to cool the generator 30. The circulating water is fed through a water supply channel 74 into a cooling system 33 of the generator 30, and is supplied from there through a water outlet channel 75 to the water return 70. Any cooling required for the linear drives 222 is likewise provided in the same way by circulating water being supplied through a water supply channel 76, and then being supplied through a water outlet channel 77 to the water return 71. The frequency converter 5 is cooled in the same advantageous manner. Its non-illustrated cooling system is supplied with circulating water through a water supply channel 78, and the circulating water is fed back to the water return 71 through a water outlet channel 79.

The circulating water in the circuit 70, 71 is cooled through the use of a heat exchanger 8 by heat energy in the circulating water being emitted to an open exchanger water circuit 81. As an alternative thereto, or in combination therewith, the circulating water may also be cooled by an air-cooled heat exchanger 9.

The cooling water may be taken in a particularly advantageous manner from a non-illustrated circuit of a corresponding power station, which is the circuit that also provides the water for producing the turbine steam. The particular advantage of this version is that the circulating water in this case is processed together with the water for the steam circuit.

Figure 2:
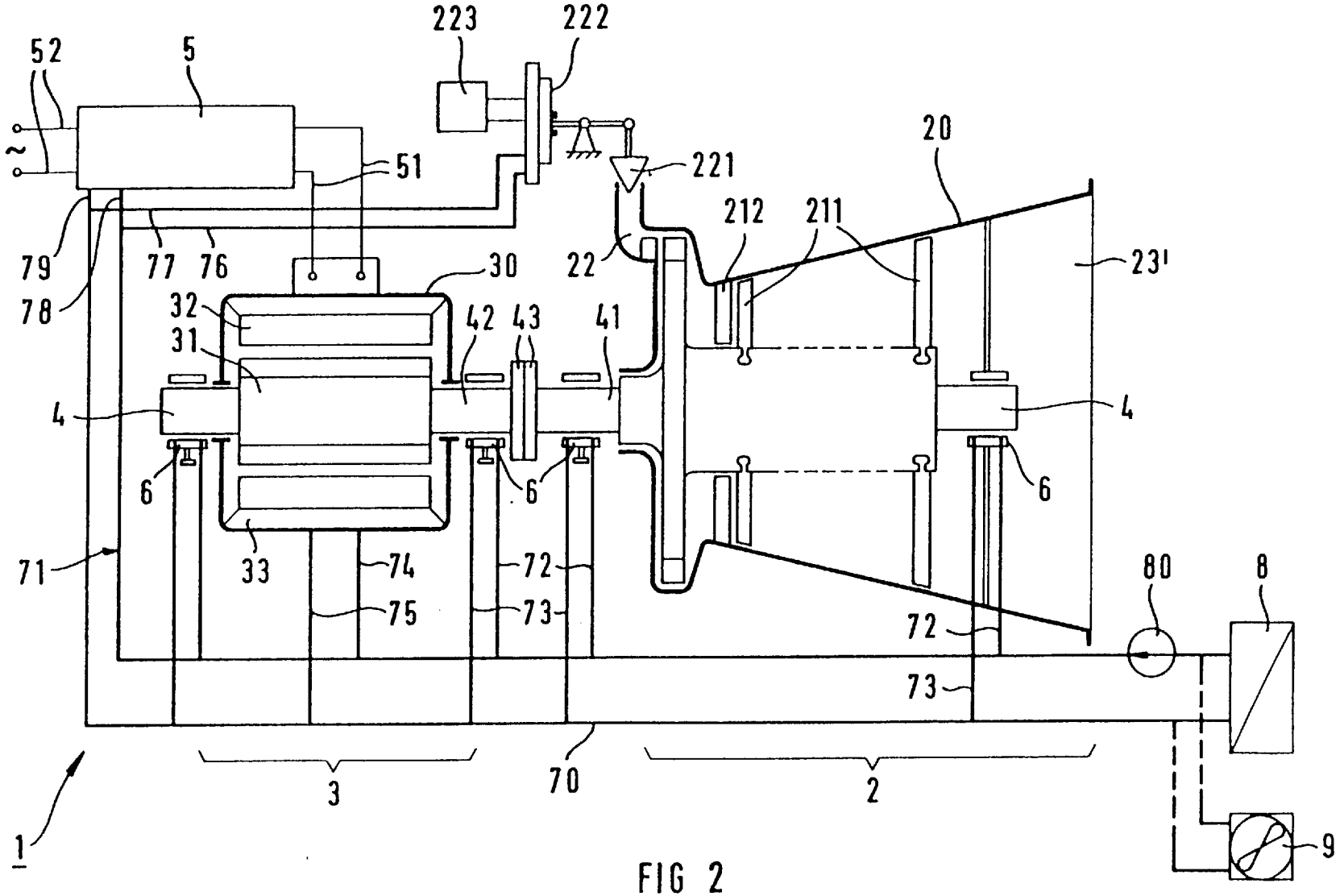
FIG. 2 is a diagrammatic and schematic view of an oil-free steam turbogenerator set using water as the lubricant and coolant with an axial steam outlet flow.

The embodiment shown in FIG. 2 has an oil-free steam turbogenerator set using water as the lubricant and coolant and having an axial steam outlet flow. Components which correspond to the embodiment in FIG. 1 have the same reference numerals. In particular, the steam turbogenerator set as such once again has reference numeral 1. In this case as well, the steam turbine generator unit 2 is connected to the generator unit 3 by a shaft 4 (namely by the two shaft elements 41 and 42). The shaft elements 41 and 42 are directly coupled to one another through flanges 43. In the generator 30, the shaft element 42 is fitted with an armature 31. Opposite and adjacent this armature is the stator 32, which is likewise contained in the generator 30. The electrical power produced by the generator 30 is supplied through cables 51 to a frequency converter 5 which, after frequency conversion, feeds the electrical power through cables 52 to an electrical network. Within the turbine 20, the shaft element 41 has rotor blades 211. Stator blades 212 are located on a stationary part of the steam turbine 20, within spaces in between the rotor blades 211.

In contrast to the exemplary embodiment in FIG. 1, the steam turbine 20 in this exemplary embodiment has a steam outlet flow device 23', which produces an axial steam outlet flow. Such an axial steam outlet flow is required, in particular, when steam turbines are installed at the same level as the generators (for example in an assembly with a gas turbine as well). As can be seen in the figure, the generator 30 is then coupled to the steam supply or inlet flow side 22 of the steam turbine 20. The steam outlet flow device 23' is normally connected to a non-illustrated condenser or a likewise non-illustrated back-pressure connection. In contrast to embodiments of steam turbines with a steam outlet flow downward or to the side, a steam turbine with an axial outlet flow requires a shaft bearing in the steam flow. Such a configuration can be seen in the right-hand part of FIG. 2. There, a shaft bearing 6 which surrounds the shaft 4 is located within the steam outlet flow device 23'. This configuration results in a considerable risk of the coolant and lubricant entering the steam circuit from the bearing 6. Where circulating water is used from the water inlet 71 for lubricating and cooling the bearing 6, as envisaged in this case, it is virtually impossible for the steam circuit medium to be contaminated by extraneous coolant and lubricant for the shaft bearing 6 located within the steam outlet flow device 23'.

Circulating water is supplied to the bearings 6 through water supply channels 72. The circulating water is passed to the water return 70 through water outlet channels 73. As in the embodiment in FIG. 1, it is once again advantageous in this case to feed the cooling system 33 of the generator 30 with circulating water through a water supply channel 74 and a water outlet channel 75. It is likewise advantageous for the linear drives 222, if necessary, and the frequency converter 5, if necessary, to be cooled by the circulating water from the water circuit 70/71.

It is of course possible, with both of the described embodiments, for the shaft 4 which is shown as being in two parts to be replaced by an integral or one-piece shaft.

I claim:

1. A method for operating a steam turbogenerator set, which comprises:

providing a steam turbine unit having a steam turbine and a shaft bearing;

providing a driven machine unit having a generator for producing electrical power;

providing a shaft having a first shaft part borne in the shaft bearing of the steam turbine unit and a second shaft part with oil-free bearings in the driven machine unit;

supplying the steam turbine unit with steam through valves driven without oil;

rotating the first shaft part with the steam turbine;

transmitting the same rotation of the shaft to the generator without an interposition of gearing by the second shaft part;

feeding water to the shaft bearing as a coolant and lubricant; and feeding electrical power from the generator through an electrical frequency converter into a load network at a predetermined network frequency.

2. The method according to claim 1, which further comprises lubricating and cooling the bearings and other bearings of rotating parts with processed water from a water circuit.

3. The method according to claim 2, which further comprises feeding water from the water circuit, for producing steam for the steam turbine.

4. A steam turbogenerator set, comprising:

a steam turbine unit having a steam turbine and a shaft bearing;

a further driven machine unit having a generator and oil-free bearings;

a shaft having a first shaft part seated in said shaft bearing in said steam turbine and a second shaft part seated in said oil-free bearings in said generator;

control valves with oil-free drives, said control valves conducting steam to said steam turbine causing said first shaft part to rotate and in turn causing said second shaft part to drive said generator, directly without an interposition of gearing;

a circuit supplying water to said shaft bearing as a lubricant and coolant; and a frequency converter connected downstream of said generator for producing electrical power at a desired frequency to be fed into a load network.

5. The steam turbogenerator set according to claim 4, wherein said shaft includes a rigid coupling between said first shaft part in said steam turbine unit and said second shaft part in said driven machine unit.

6. The steam turbogenerator set according to claim 4, wherein said shaft including said first shaft part in said steam turbine unit and said second shaft part in said driven machine unit are integral and borne only in said shaft bearing.

7. The steam turbogenerator set according to claim 4, wherein said steam turbine unit has an outlet flow in axial direction, and said shaft bearing is disposed in said outlet flow.

8. The steam turbogenerator set according to claim 4, wherein at least one bearing for said second shaft part in said driven machine unit is fed with water as a lubricant and coolant.

9. The steam turbogenerator set according to claim 4, wherein said oil-free drives of said control valves are oil-free linear drives.

10. The steam turbogenerator set according to claim 4, wherein said water circuit is fed with processed water from a water circuit of a power station.

11. The steam turbogenerator set according to claim 4, wherein said water circuit is fed with processed water from a water circuit of a power station supplying steam for said steam turbine unit.

* * * * *